United States Patent [19]

Sterling et al.

[11] 4,100,000

[45] Jul. 11, 1978

[54] PRILLED EXPLOSIVE COMPOSITION

[75] Inventors: Thomas S. Sterling, Ottawa; Jean-Yves Belanger, Ste. Foy; Kenneth S. Kalman, Dollard des Ormeaux, all of Canada

[73] Assignee: Her Majesty the Queen in right of Canada, as represented by the Minister of National Defence, Ottawa, Canada

[21] Appl. No.: 735,339

[22] Filed: Oct. 26, 1976

[30] Foreign Application Priority Data

May 31, 1976 [CA] Canada ..... 253728

[51] Int. Cl.[2] ..... C06B 45/36

[52] U.S. Cl. ..... 149/4; 149/2; 149/5; 149/92; 149/105; 264/3 C; 264/3 E

[58] Field of Search ..... 149/2, 105, 92, 4, 5; 264/3 C, 3 E

[56] References Cited

U.S. PATENT DOCUMENTS

| | | | |
|---|---|---|---|
| 3,754,061 | 8/1973 | Forrest et al. | 149/105 X |
| 3,882,208 | 5/1975 | Geresy | 149/105 X |

*Primary Examiner*—Stephen J. Lechert, Jr.
*Attorney, Agent, or Firm*—Thomas O. Maser

[57] ABSTRACT

A free-flowing explosive composition exhibiting high brisance and high blasting power is described, comprising 35–80% by weight TNT, 10–30% by weight aluminum and 0–45% by weight RDX, in spheroidal prill form.

14 Claims, 4 Drawing Figures

PRILLED EXPLOSIVE COMPOSITION

This invention relates to an explosive composition, and in particular to a free-flowing explosive composition exhibiting both high brisance and high blasting power.

In blasting and cratering operations it is important that an explosive charge first breaks or shatters the ground material around the bore hole. This is especially important in blasting hard rock or permafrost. This shattering power is known as brisance. Secondly, the shattered material must be displaced from the area of the bore hole to form a crater. The amount of displaced material is a measure of the blasting power of the explosive.

Explosives generally fall into four main categories (1) solid cast types (2) particulate solids (3) slurries and (4) gels.

The solid cast types are generally high in density, but because of their fixed shape and size may not be satisfactorily loaded into nonuniform bore holes. Therefore, despite their high density, it is impossible to fill the bore-hole with a maximum weight of explosive.

Slurries are generally impractical in cold environments, since they are difficult to handle at low temperatures.

Gels suffer from short shelf lives and are temperature sensitive.

Granular free-flowing explosives which overcome most of these difficulties are known. However, they are generally low in density and are subject to desensitisation by water. Thus, in water-filled bore holes, there is a tendency to float and for detonation to be difficult. For example, trinitrotoluene (TNT) has been prepared in various particulate forms.

One such form is described in British Pat. No. 755,695, published Aug. 22, 1956, in the name of E.I. DuPont de Nemours and Co. This patent discloses an explosive comprising pure TNT in the form of relatively uniform, substantially spherical pellets having a diameter of from 1/16 inch to 3/16 inch. The absolute density of the TNT pellets is disclosed as being in the range of 1.55 to 1.60 g/cm$^3$, the bulk density being of the order of 0.90 to 1.05 g/cm$^3$.

Such TNT pellets when used as a blasting explosive suffer from two main disadvantages, i.e. only average brisance and low blasting power.

It is thus an object of the invention to provide a free-flowing, high-density, water-resistant explosive composition.

It is a further object of the invention to provide an explosive composition which is useful over a wide temperature range and which exhibits long shelf-life.

It is yet another object of the invention to provide an explosive composition which exhibits both high brisance and high blasting power.

These and other objects are achieved according to the present invention by providing a free-flowing, high-density, water-resistant explosive composition comprising 35–80% by weight TNT, 10–30% by weight Aluminum, and 0–45% by weight RDX, in spheroidal prill form.

Applicant has found that the brisance and blasting power of TNT may be increased by replacing some of the TNT with suitable explosive ingredients. For example, if RDX (cyclonite -a sensitive, very powerful explosive) is added to TNT, the brisance is considerably increased as compared to pure TNT. Moreover, the addition of aluminum in the form of a finely divided powder of particle size in the range of 0.5 to 50 microns increases the temperatures and pressure of the detonation products, resulting in a higher blasting power. The preferred particle size of the aluminum powder is about 2 microns.

TABLE I

DATA FROM LABORATORY-SCALE EXPERIMENTS

| Run | Composition % by weight | | | | | | | | Density g/cm$^3$ | | Prill size (mm) % by weight | | | | Nozzle | Explosive | Production |
|---|---|---|---|---|---|---|---|---|---|---|---|---|---|---|---|---|---|
| | nominal | | | | measured | | | | absolute | bulk | | | | | diameter | temperature | rate |
| No. | TNT | RDX | Al | | TNT | RDX | Al | | theoretical | typical | 0-1.5 | 1.5-3 | 3-5 | >5 | mm | ° C | kg/h |
| 1 | 100 | — | — | — | 100 | — | — | — | 1.65 | 1.04 | — | 1 | 17 | 82 | 2.06 | 83 | — |
| 2 | 80 | — | 20 | — | 80 | — | 20 | — | 1.86 | 1.13 | 3 | 9 | 88 | — | 1.52 | 86 | 0.9 |
| 3 | 80 | — | 20 | — | 80 | — | 20 | — | 1.86 | 1.13 | 1 | 25 | 58 | 16 | 2.06 | 86 | 3.6 |
| 4 | 48 | 35 | 17 | — | 50 | 35 | 15 | — | 1.89 | 1.20 | 1 | 26 | 44 | 29 | 1.52 | 88 | — |
| 5 | 45 | 45 | 10 | — | 46 | 43 | 11 | — | 1.83 | 1.18 | — | 5 | 95 | — | 2.06 | 83 | — |
| 6 | 42 | 42 | 16 | — | 41 | 40 | 19 | — | 1.90 | 1.20 | — | 77 | 23 | — | 1.52 | 86 | — |
| 7 | 42 | 42 | 16 | — | 42 | 39 | 19 | — | 1.90 | 1.21 | 2 | 72 | 26 | — | 1.52 | 89 | — |
| 8 | 42 | 42 | 16 | — | 41 | 42 | 17 | — | 1.90 | 1.19 | 4 | 63 | 32 | 1 | 1.52 | 93 | — |
| 9 | 42 | 42 | 16 | — | 41 | 42 | 17 | — | 1.90 | 1.20 | 1 | — | 99 | — | 2.06 | 83 | — |
| 10 | 42 | 42 | 16 | — | 42 | 40 | 18 | — | 1.90 | 1.20 | 1 | 20 | 79 | — | 2.06 | 86 | — |
| 11 | 42 | 42 | 16 | — | 42 | 41 | 17 | — | 1.90 | 1.21 | 1 | 33 | 66 | — | 2.06 | 93 | — |
| 12 | 42 | 42 | 16 | — | 41 | 42 | 17 | — | 1.90 | 1.20 | 0 | 1 | 57 | 42 | 2.54 | 83 | — |
| 13 | 40 | 40 | 20 | — | 39 | 40 | 21 | — | 1.93 | 1.22 | 2 | 42 | 55 | 1 | 2.06 | 91 | 0.59 |
| 14 | 40 | 40 | 20 | — | 41 | 39 | 20 | — | 1.93 | 1.21 | 1 | 50 | 47 | 2 | 2.06 | 91 | 0.63 |
| 15 | 40 | 40 | 20 | — | 41 | 39 | 20 | — | 1.93 | 1.21 | 1 | 42 | 54 | 3 | 2.06 | 91 | 0.54 |
| 16 | 40 | 40 | 20 | — | 42 | 38 | 20 | — | 1.93 | 1.22 | 2 | 13 | 85 | — | 2.06 | 83 | 0.32 |
| 17 | 40 | 40 | 20 | — | 42 | 39 | 19 | — | 1.93 | 1.20 | 2 | 12 | 86 | — | 2.06 | 83 | 0.36 |
| 18 | 40 | 40 | 20 | — | 42 | 39 | 19 | — | 1.93 | 1.22 | 2 | 12 | 86 | — | 2.06 | 83 | 0.36 |
| 19 | 35 | 35 | 30 | — | 35 | 35 | 30 | — | 2.02 | 1.26 | 1 | 1 | 98 | — | 2.06 | 83 | — |

As seen in the Table I, the amount of TNT in the explosive composition may range from 35–80%/W, the amount of Aluminum from 10–30%/W and the amount of RDX from 0–45%/W.

All compositions contained TNT as the carrier fluid for other ingredients. Run 1 contained only TNT whereas, in the others, a fraction of this energetic fluid was replaced by some combination of RDX and aluminum to investigate the possibility of substituting some of the TNT by these materials. The theoretical densities calculated from the crystal density of each of the ingredients ranged from 1.65 g/cm$^3$ for pure TNT to 2.02 g/cm$^3$ for the formulation TNT/RDX/A1 (35/35/30), and their bulk densities measured in a 5-cm diameter cylinder were 1.05 and 1.26 g/cm$^3$, respectively.

Table I also gives the chemical analyses of the prills produced and their size distributions. The analyses, based on the preferential dissolution of TNT in benzene and RDX in acetone, shown that the TNT content was often 1 to 2% higher than the formulated composition. The prill size fractions, obtained by dry sieving with a round-hole sieve, were generally between 0 and 5 mm.

The formulations contained RDX may be prepared from a combination of Composition B, TNT and aluminum. For example, if 100 lb of pelleted Composition B, which is a 60/40 mixture of RDX/TNT, is added to 20 lb of molten TNT, and 25 lb of aluminum powder is subsequently added, a 40/40/20 TNT/RDX/A1 composition results.

Since Composition B contains some wax, the prills produced also contained wax as a desensitizing additive. No desensitizer was added to runs 1, 2 and 3, which did not contain RDX.

To impede the possible reaction of aluminum with water or water vapour, ammonium lignosulfonate (a deactivating agent) was added, at a concentration of about 0.1%/W to formulations containing aluminum. Subsequent testing, showed that no gas evolved when prills, with or without lignosulfonate, were submerged in water at 20° C for 50 days.

It was found that the amounts of RDX and aluminum added are only limited by the viscosity of the molten composition which enables it to flow through nozzles of appropriate diameter to form free-flowing prills of diameters in the range of 1–5 mm. For example, if the molten explosive composition is too viscous, production rates will be slow and the nozzles tend to clog.

The following is a list of raw materials used as ingredients in the preparation of the Prilled Explosives: (hereinafter referred to as HEBP).

Trinitrotoluene (TNT): Grade 1, TNT MIL-SPEC-T-248A, produced by Canadian Industries Ltd., Montreal.

Composition "B": Grade A of nominal viscosity of 5 s, MIL SPEC C-401D, produced by Canadian Industires Ltd., Montreal.

Aluminum: Atomized Grade SA-24, mean particle size 2 μm, produced by Aluminum Co. of Canada, Montreal.

Ammonium Lignosulfonate (TSD): Technical grade, produced by Lignosol Chemicals, Quebec.

The Laboratory studies determined the parameters which control the properties of the finished product. These parameters are now discussed.

EFFECT OF TEMPERATURE ON PRILL FORMATION

Two temperature ranges of the molten suspension of explosive were mainly investigated: the first between the melting point of TNT (81° C) and 86° C, where the viscosity of the suspension is relatively high and varies rapidly with temperature and the second from 90° to 93° C, where the viscosity is lower and relatively constant.

The effect of temperature on the formation of prills was studied with the formulation TNT/RDX/A1: 42/42/16; data from Table I has been reproduced in Table II for ease of comparison. Here it can be seen that the size of prills decreased with increasing temperature. At 83° C,

TABLE II

Effect of Temperature on Prill Size Distribution (TNT/RDX/Al: 42/42/16: 2.06 mm nozzle)

| Temperature ° C | Bulk density g/cm³ | prills (nm) % by weight 0-1.5 | 1.5-3 | 3-5 | >5 | Run |
|---|---|---|---|---|---|---|
| 83 | 1.20 | 1 | — | 99 | — | 9 |
| 86 | 1.20 | 1 | 20 | 79 | — | 10 |
| 93 | 1.21 | 1 | 33 | 66 | — | 11 |

99% by weight of the prills were between 3 to 5 mm, while at 93° C only 66% were of this size, 33% being between 1.5 and 3 mm. This change in size, however, had no effect on the bulk density, which remained at about 1.20 g/cm³. These results indicate that if a uniform prill size is required, the fluid temperature should be as low as the process permits (−83° C). On the other hand, if a wider distribution is acceptable, the pellets can be produced at a higher temperature.

Why this is so, can be explained by observing the formation of the prills. At temperatures slightly above the melting point of the TNT (83°–86° C), the viscosity is relatively high and the flow through the nozzle is slow enough so that the droplets are formed one by one at the tip of the nozzle; when enough mass is present to overcome the surface tension at the nozzle tip, the droplet falls off. It is still molten at this point and tends to flatten slightly, due to the resistance of water. When the explosive fluid is at a high temperature (>90° C), the viscosity is substantially lower and the fluid flows in a continuous manner into the water column and breaks up into droplets of different sizes, likely due to the stalling effect of the flow into a stationary medium. A variety of droplet sizes are obtained at this temperature, often with a needle hole appearing in the cooled prills.

EFFECT OF TEMPERATURE ON PRODUCTION RATE

The rate of production of HEBP was mainly studied at 83° and 91° C with the formulation TNT/RDX/A1: 40/40/20, using the 2.06-mm mozzle. Table III gives the results of three runs conducted at each temperature. Here

TABLE III

Effect Of Temperature On Production Rate (TNT/RDX/Al: 40/40/20; 2.06-mm nozzle)

| Run | Temperature ° C | Production rate kg/h |
|---|---|---|
| 17 | 83 | 0.32 |
| 18 | 83 | 0.36 |
| 19 | 83 | 0.36 |
| | | Ave = 0.35 |
| 14 | 91 | 0.59 |
| 15 | 91 | 0.63 |
| 16 | 91 | 0.54 |
| | | Ave = 0.59 |

it can be seen that the average production rate increased by about 68% from 0.35 to 0.59 kg/h when the temperature was raised from 83° to 91° C. Although not measured, the viscosity at 91° C can be estimated to be about 60% of that at 83° C.

Using data from run 3 of Table I, the production rate of TNT/A1: 80/20 prills from the same nozzle diameter (2.06 mm) was 3.6 kg/h at 86° C. That is, the addition of RDX to the composition greatly reduced the production rate (a direct comparison is not possible because the temperatures were not the same).

EFFECT OF NOZZLE DIAMETER ON SIZE OF PRILLS

An effective nozzle must have a diameter permitting a continuous flow (i.e. no blockage) and production of prills of about 3 mm. With this in mind, nozzles of 1.52, 2.06 and 2.54 mm in diameter were tested with two formulations (TNT/RDX/Al: 80/0/20 and 42/42/16); the results are reported in Table IV.

TABLE IV

PRILL SIZE DISTRIBUTION FOR THREE NOZZLE DIAMETERS

| Nozzle diameter | Temp | Composition | | | Bulk density | Prill size (mm) % by weight | | | | |
|---|---|---|---|---|---|---|---|---|---|---|
| run | ° C | TNT | RDX | Al | g/cm³ | 0-1.5 | 1.5-3 | 3-5 | >5 | Run |
| 1.52 | 86 | 80 | 0 | 20 | 1.13 | 3 | 9 | 88 | 0 | 2 |
| " | 86 | 42 | 42 | 16 | 1.20 | 0 | 77 | 23 | 0 | 6 |
| " | 93 | 42 | 42 | 16 | 1.19 | 4 | 63 | 32 | 1 | 8 |
| 2.06 | 86 | 80 | 0 | 20 | 1.13 | 1 | 25 | 58 | 16 | 3 |
| " | 86 | 42 | 42 | 16 | 1.20 | 1 | 20 | 79 | 0 | 10 |
| " | 93 | 42 | 42 | 16 | 1.21 | 1 | 33 | 66 | 0 | 11 |
| 2.54 | 83 | 42 | 42 | 16 | 1.20 | 0 | 1 | 57 | 42 | 12 |

When both the 1.52- and 2.06-mm nozzles were used with the 42/42/16 composition, the prill size decreased with increasng temperature, as previously noted. In addition, the 42/42/16 prills were smaller than 5 mm for both nozzles at both test temperatures (86° and 93° C). On the other hand, with the 80/0/20 composition 16% of the prills were greater than 5 mm using the 2.06-mm nozzle at 86° C, whereas none were with the smaller nozzle.

While not directly comparable, because the temperature was different, virtually all the prills were greater than 3 mm and nearly half were greater than 5 mm when the 42/42/16 composition was prilled through a 2.54l-mm nozzle at 83° C. These prills, however, were less rounded than those from the other two nozzle sizes.

In general it was noted that the bulk density was not affected by either nozzle size or temperature, and that the 1.52-mm nozzle tended to block with the 42/42/16 composition.

As mentioned previously, the explosive composition according to the invention has superior free-flowing properties. This is achieved by the spheroidal shape and size of the prills and is enhanced by graphitization. Moreover, spheroidal shape allows for better packing and hence a higher bulk density of the explosive in a bore hole.

Graphitizing as well as enchancing of the free-flow properties of the prills, also reduces greatly the possibility of accumulation of static electric charge on the prills. Moreover, the water solubility of the prills, which is already very low, is further reduced. Graphitization also provides additional protection for the aluminum in the prills from hydrolysis with the water vapour in air.

The formation of explosive dust generated during handling and transport is also minimized by graphitization.

Moreover, the explosive prills according to the present invention can be used as blasting explosives in a wide range of temperature extremes without significant variation in performance, safety or free-flow properties.

Also, the results of vacuum stability, electrical conductivity, evolution of hydrogen, formation dust etc, tests indicate a very long safe shelf life, estimated at over 20 years.

In the drawings which serve to illustrate the preferred embodiment of the invention:

Figure 1:
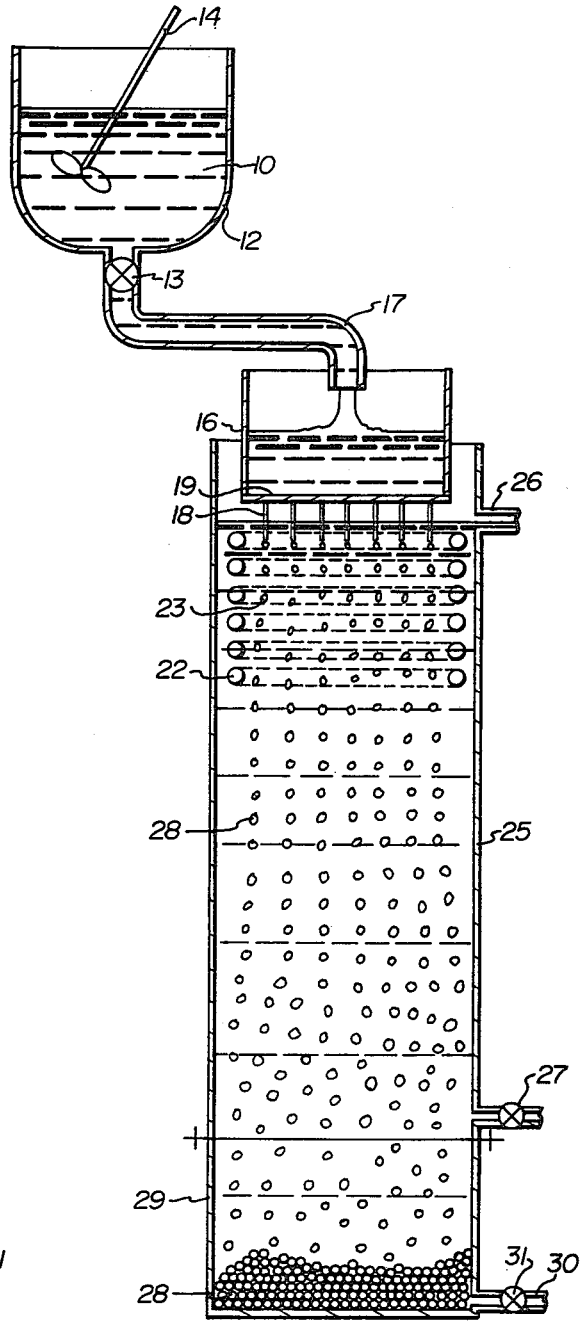
FIG. 1 illustrates a pilot plant prilling tower according to the invention.
Figure 2:
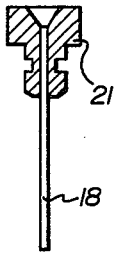
FIG. 2 is an exploded view of a nozzle used to form the prills according to the present invention.

The following examples illustrate the advantages of the preferred explosive compositions according to the present invention in prill form, over known explosives, particularly, prilled pure TNT. The data for example I is taken from the Laboratory scale expreiments described in Table I for comparison purposes and the data for examples 2 and 3 is taken from results of the experiments run on the pilot plant prilling tower illustrated in FIG. 1.

EXAMPLE I

| COMPOSITION: Pure TNT | | |
|---|---|---|
| SHAPE AND APPEARANCE: | Prill diameter (mm) | %/W |
| | 1.5-3 | 1 |
| | 3-5 | 17 |
| | >5 | 82 |
| DENSITY: Absolute | 1.65 | g/cm³ |
| theoretical | | |
| bulk typical | 1.04 | " |

EXAMPLE II

| | |
|---|---|
| COMPOSITION: TNT | 40%/W |
| RDX | 40%/W |
| Al | 20%/W |

SHAPE AND APPEARANCE

The prills have an average size of about 3 mm. A thin coating of graphite on the prills, to make them semiconductive, gives them a black appearance.

DENSITY:

| | |
|---|---|
| absolute | 1.93 g/cm³ |
| Bulk (in air) | 1.22 " |
| Bulk (in water) | 1.54 " |
| Bulk (in ice) | 1.5 " |

VACUUM STABILITY

Several 5 g samples were heated for 48 h at 100° C; an average of 0.27 cm³ of gas was evolved.

CONDUCTIVITY

The electrical resistance of graphitized prills, measured between 18 $cm^2$ cylindrical plates 2.5 cm apart, was about $0.5 \times 10^6\Omega$ compared to values higher than $20 \times 10^6\Omega$ for uncoated prills. In practice, this means that any build-up of static electrical charges is eliminated.

EVOLUTION OF $H_2$

There is no evolution of $H_2$ gas when 10 g of prills are exposed to moist air, or submerged in water, for 50 days at 20° C.

FORMATION OF DUST

A negligible quantity of dust was formed when prills were roughly treated in a roller mill for 8 hours.

DETONATION VELOCITY (NO CONFINEMENT)

TABLE V

| Condition of Prills | Detonation Velocity (km/s) at Charge Diameter of: 1.0 in | 1.5 in | 2.0 in | 3.0 in+ | 4.0 in |
|---|---|---|---|---|---|
| In air | No | 4.6 | 5.0 | 5.0 | 5.0 |
| In water | 6.2 | 6.4 | 6.8 | 6.6 | |
| In ice | — | 6.4 | 6.6 | — | — |

+should be fired with longer charges.

These results indicate that in air, a charge will detonate at a steady state in bore holes as low as 1.5 inches in diameter. In water and probably in ice, detonation at a steady state is achieved in bore holes as low as 1 inch in diameter. This indicates that water may be purposely added to the bore hole to propagate detonation or to increase the detonation velocity and hence the brisance. In other words, this composition is water-resistant.

CRITICAL DIAMETER

The critical diameter is the smallest diameter of a bore hole in which a charge will detonate at a steady state.

The above measurements indicate that the detonation of 40/40/20 prills in air, water or ice is stable with charge diameters of 1.5 inches or more.

DETONATOR SENSITIVITY

A No. 12 detonator fully immersed in a 2-in diameter charge of prills failed to detonate the charge, and the bulk of the charge was recovered, i.e. not detonator sensitive.

PRIMER SENSITIVITY

A 0.62-in diameter by 0.68-in thick pellet of tetryl placed on top of a 2.0-in diameter charge of prills failed to detonate the charge.

A 2.0-in diameter charge can be initiated:

(a) by a 1.25-in diameter by 0.62-in thick tetryl pellet weighing 18 g placed in contact with one end of the charge; or (b) by a 0.25-in thick by 2.0-in long piece of C4 (demolition charge) weighing 21 g placed in contact with one end of the charge.

STORAGE

To date, prills have been stored for up to two years without deterioration.

Sixteen batches were required to produce about 1000 kg of 40/40/20 prills; the production rate, prill size distribution and bulk density for each of these batches are listed in Table VI.

TABLE VI

Tower Performance for TNT/RDX/Al:40/40/20 Prills (Temperatures = 83 - 86° C; 2.06-mm nozzle)

| Batch | Bulk density g/$cm^3$ | Prill size (mm) % by weight 0-1.5 | 1.5-3 | 3-5 | >5. | Production rate kg/h |
|---|---|---|---|---|---|---|
| CR-1 | 1.20 | — | 3 | 97 | — | 13.6 |
| CR-2 | 1.22 | 3 | 21 | 74 | 2 | 14.1 |
| CR-3 | 1.22 | 4 | 28 | 64 | 4 | 22.7 |
| CR-4 | 1.22 | 3 | 17 | 79 | 1 | 14.1 |
| CR-5 | 1.23 | 2 | 13 | 85 | — | 10.6 |
| CR-6 | 1.22 | 2 | 10 | 88 | 1 | 12.7 |
| CR-7 | 1.23 | 2 | 19 | 78 | 1 | 14.7 |
| CR-8 | 1.21 | 4 | 24 | 72 | — | 16.9 |
| CR-9 | 1.22 | 2 | 14 | 84 | — | 15.1 |
| CR-10 | 1.21 | 4 | 18 | 78 | — | 13.4 |
| CR-11 | 1.24 | 2 | 16 | 82 | — | 15.1 |
| CR-12 | 1.22 | 2 | 23 | 75 | — | 15.8 |
| CR-13 | 1.22 | 5 | 25 | 70 | — | 14.9 |
| CR-14 | 1.21 | 2 | 30 | 66 | — | 14.2 |
| CR-15 | 1.22 | 4 | 20 | 76 | — | 13.6 |
| CR-16 | 1.22 | 4 | 18 | 78 | — | 13.6 |
| MEAN | 1.22 | 3 | 19 | 77 | 1 | 14.7 |

The average production rate was 14.7 kg/h (= 0.38 kg/h/nozzle), which compares favourably with the 0.34-kg/h average of laboratory runs 17 and 19 (Table I) with the same composition, nozzle and operating temperature.

The prill size distributions are also similar to those obtained during the laboratory studies. Slight differences from batch to batch and from the laboratory studies can be explained by the larger variation of the temperature in the plant scale ( 3° C) than in the laboratory studies ( 1.5° C).

The bulk density of the prills obtained was about 1.22 g/$cm^3$, the same value measured during the laboratory studies.

The TNT, RDX and A1 content of the prills was determined by chemical analysis for runs CR-1 to 3. Since the percentage of each ingredient was identical to the calculated formulation for two of the three runs, and only 1% off for TNT and RDX in the third run, this test was judged unnecessary and discontinued.

The water content of many samples of the finished product, determined by the Karl Fisher method, showed that the prills generally contained between 60 to 90 ppm of water.

EXAMPLE 3

| | | |
|---|---|---|
| COMPOSITION: | TNT | 80%/w |
| | Al | 20%/w |
| SHAPE AND APPEARANCE | | |
| Same as 40/40/20 | | |
| DENSITY | | |
| Absolute | | ~1.72 g/$cm^3$ |
| Bulk (in air) | | 1.12 " |
| Bulk (in water) | | 1.46 " |
| Bulk (in ice) | | ~1.43 " |
| VACUUM STABILITY | | |
| Several 5 g samples were heated for 48 hrs at 100° C; an average of 0.066 $cm^3$ of gas was evolved. | | |
| CONDUCTIVITY | | |
| Same as 40/40/20 | | |
| EVOLUTION OF $H_2$ | | |
| Same as 40/40/20 | | |
| FORMATION DUCT | | |
| Same as 40/40/20 | | |

INITIATION *

A 3.0-in diameter charge can be initiatedl: by a 1.0in thick by 2.0-in long piece of C4 (demolition charge) weighing about 95 g.

* More recent test conducted on the velocity of detonation have shown that with a charge diameter of 3-in the detonation is probably of low-order.

DETONATION VELOCITY

TABLE VII

| Condition of Prills | Detonation Velocity (km/s) at Charge Diameter of: 1.0 in | 1.5 in | 2.0 in | 3.0 in | 4.0 in |
|---|---|---|---|---|---|
| In air | No | No | No | 3.0 (Low order) | 4.0 |
| In water | + | 5.9 | 6.0 | 6.1 | — |
| In ice | — | 5.8 | 5.9 | — | — |

+ More recent test conducted on the velocity of detonation have shown that with a charge diameter of 3-in the detonation is probably of low-order.

TNT/A1 composition will not detonate steadily in air in bore holes less than about 4 inches diameter, but will detonate at steady state in as low as 1.5 inches diameter bore holes in water or ice. The higher detonation velocities in water and ice indicate a higher brisance when used in these media. In other words, this composition is water-resistant. In fact, water or ice may be purposely added to the bore holes to effect detonation or to increase the brisance.

CRITICAL DIAMETER

The measurements to date indicate that the detonation of 80/20 prills in water or ice is stable with charge diameters of 1.5-in or more. However even for a diameter of 3.0-in in air the detonation is of low order type. (i.e. non steady state detonation).

Thirteen batches were required to produce about 1000 kg of 80/20 prills; the production rate, prill size distribution and bulk density for each of the batches are listed in Table VIII.

TABLE VIII

Tower Performance for TMT/A1:80/20 (Temperature = 83–86° C; 2.06 mm nozzle)

| Batch | Bulk density g/cm³ | Prill size (mm) % by weight 0-1.5 | 1.5-3 | 3-5 | >5 | Production rate kg/h |
|---|---|---|---|---|---|---|
| TR-1 | 1.13 | 4 | 41 | 51 | 4 | 56.8 |
| TR-2 | 1.13 | 2 | 36 | 61 | 1 | 45.5 |
| TR-3 | 1.14 | 4 | 43 | 52 | 1 | 50.0 |
| TR-4 | 1.11 | 2 | 38 | 59 | 1 | 67.3 |
| TR-5 | 1.11 | 4 | 39 | 55 | 2 | 68.2 |
| TR-6 | 1.13 | 4 | 38 | 56 | 2 | 68.2 |
| TR-7 | 1.11 | 2 | 41 | 55 | 2 | 72.7 |
| TR-8 | 1.11 | 2 | 40 | 56 | 2 | 90.9 |
| TR-9 | 1.12 | 2 | 31 | 61 | 6 | 79.5 |
| TR-10 | 1.13 | 3 | 37 | 57 | 3 | 81.8 |
| TR-11 | 1.12 | 4 | 40 | 54 | 2 | 90.9 |
| TR-12 | 1.12 | 4 | 40 | 53 | 3 | 90.9 |
| TR-13 | 1.12 | 4 | 40 | 53 | 3 | 86.4 |
| MEAN | 1.12 | 3 | 39 | 55 | 3 | 73.0 |

The average production rate was 73.0 kg/h (1.87 kg/h/nozzle), which is only about half the 3.6 kg/h obtained from laboratory run 3 (Table 1) with the same composition, nozzle and operating temperature. This was due to the much lower head of molten explosive over the nozzle in the drop pan of the tower, which was only 1 cm as compared to anything from 1 to 10 cm in the laboratory run.

The much higher production rate of the 80/20 prills, 73.0 kg/h compared to 14.7 kg/h for the 40/40/20 prills, is explained by the much lower viscosity of the molten suspension of the former. The molten explosive containing 80% of TNT and 20% of solids is obviously much more fluid than one that contains only half that amount of TNT and three times the quantity of solids.

A comparison of the average prill size distribution of the tower prills to that of laboratory run 3 shows that the percentage of prills in excess of 5 mm was greatly reduced in the tower. This can again be explained by the lower head of explosive over the nozzles because the prills will form more slowly and, therefore, more uniformly.

The average bulk density of the tower prills was 1.12 g/cm³, which compares favourably with the 1.13 g/cm³ obtained in the laboratory.

The TNT and A1 content of the prills was determined by chemical analysis for runs TR-1, 2 and 5. When they were found to be identical to the formulated composition,, this determination was discontinued.

The pilot-plant prilling tower shown in FIG. 1, for the production of high-energy blasting prills, has been developed, built and put into operation. It can produce about 90 kg per batch at rates of 73.0 kg/h of TNT/A1:80/20 prills or 14.7 kg/h of TNT/RDX/A1:40/40/20 prills. The difference in production rates depends solely on the much lower viscosity of the formulation with 80% of TNT.

Chemical analyses conducted on both types of prills found the final composition to be identical to be formulated composition, indicating that the molten explosive suspension was homogenous in both the melting hopper and the drop pan.

For a given formulation, the production rate and prill size distribution depend on the nozzle size, the operating temperature and the head of explosive above the nozzles. An operating temperature of 83° to 86° C with 2.06 mm diameter nozzles was usedfor the production of prills in the illustrated embodiment. The head of explosive was maintained at 6 mm for the 40/40/20 prills and at 1 cm for the less viscous 80/20 prills. Under these conditions the average particle size of the prills was about 3 mm.

To eliminate the build-up of static electrical charges on the prills, a graphitization process was developed that deposits a thin coat of graphite over the prills. By so doing, the electrical resistance was reduced from 20 $\times 10^6\Omega$ to 0.5 $\times 10^6\Omega$ and thereby rendered the prills safe to handle and store for long periods. In addition, the HEBP do not react with water.

Comparing the bulk densities of the two preferred explosive compositions according to the invention to that of TNT, it is seen that the values set forth in examples 2 and 3 are considerably higher than that for pure prilled TNT. This means that a greater weight of explosive per unit volume may be loaded into a bore hole.

Figure 4:
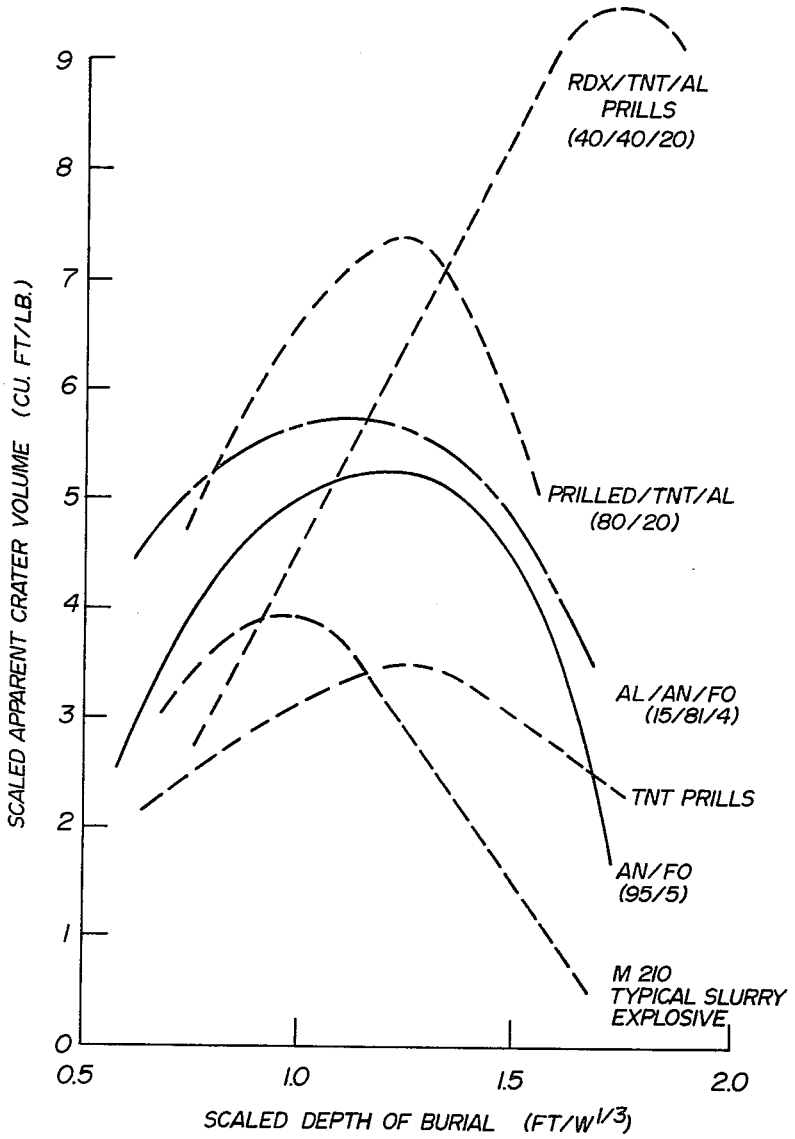
FIG. 4 is a graph illustrating the combined high brisance and high blasting power of the compositions according to the present invention, in prill form.

Looking now at FIG. 4, which is essentially a measure of the performance of various explosives with respect to cratering ability in terms of the volume of material displaced, it is seen that the explosive yields in terms of cubic feet excavated per pound of explosive varies widely between explosive types. It is evident, for example, that prilled RDX/TNT/A1 proved superior as a cratering explosive. However it is difficult to get an overall picture of all the explosives tested. Because of this, an attempt has been made to indicate the relative performance of each explosive by calculating a regression line through the data of each explosive type. These regression lines were then plotted on an appropriate graph to present an indication of their relative performance. FIG. 4 presents these regression lines for scaled apparent crater volume against scaled depth of burial.

It should be noted here that this curve does not represent a design curve nor should it be construed in any other way than as purely indicative of the eight shots fired for each explosive in this present test programme.

To summarize the relative performance of the explosives based on their apparent crater volume the results fall into four convenient groups, these being:

(1) prilled RDX/TNT/A1, and prilled TNT/A1 were similar in performance and proved to be the most effective cratering explosives.

(2) AN/FO and A1/AN/FO performed well but not as well as Group (1). Al/AN/FO proved superior to AN/FO.

(3) This Group, TNT prills; and M210 Hydromex ®, PERFORMED similarly but not as effectively as either Groups (1) or (2).

The actual composition of the various explosives tested are as follows:

(1) Prilled RDX/TNT/A1 (40/40/20)
(2) Prilled TNT/A1 (80/20)
(3) Prilled pure TNT
(4) AN/FO (95/5)
(5) A1/AN/FO (15/81/4)
(6) M210 Hydromex ® - commercial aluminised T.N.T. sensitised slurry (aluminum content 10%).

It will be apparent from the graphical results that for combined high brisance and high blasting power, for use in hard rock, permafrost etc., the preferred composition is:

TNT/RDX/A1 (40/40/20) in prill form.

For average brisance and high blasting power, for use in most soils and minerals, the preferred composition is:

TNT/A1 (80/20) in prill form.

It is noted that both of these compositions are clearly superior to pure TNT and prill form.

It is also noted that the latter composition is appreciably cheaper than the former, although it is not quite as good for use as a blasting explosive.

Preferably, the amount of aluminum is maintained at about 20%/W, since this amount represents the optimum for maximum blasting power enhancement.

The explosive prills of the present invention are made according to the following method.

The method broadly comprises:

(a) forming a molten mixture of an explosive composition according to the invention,
(b) forming droplets of the molten mixture,
(c) solidifying the droplets by cooling to form spheroidal prills of the explosive composition, and
(d) collecting the prills.

The prills may then be dried and graphitised.

More specifically, with reference to FIG. 1 of the drawings, the method consists of forming a molten mixture 10 of an explosive composition according to the invention in a melting hopper 12 heated to a temperature above the melting point of the mixture by means not shown. The hopper 12 is equipped with an automatically controlled flush-mounted dumping valve 13 located at the centre of its bottom.

Homogeneity of the mixture is maintained by agitating means 14 rotating at about 80 rpm.

Figure 3:
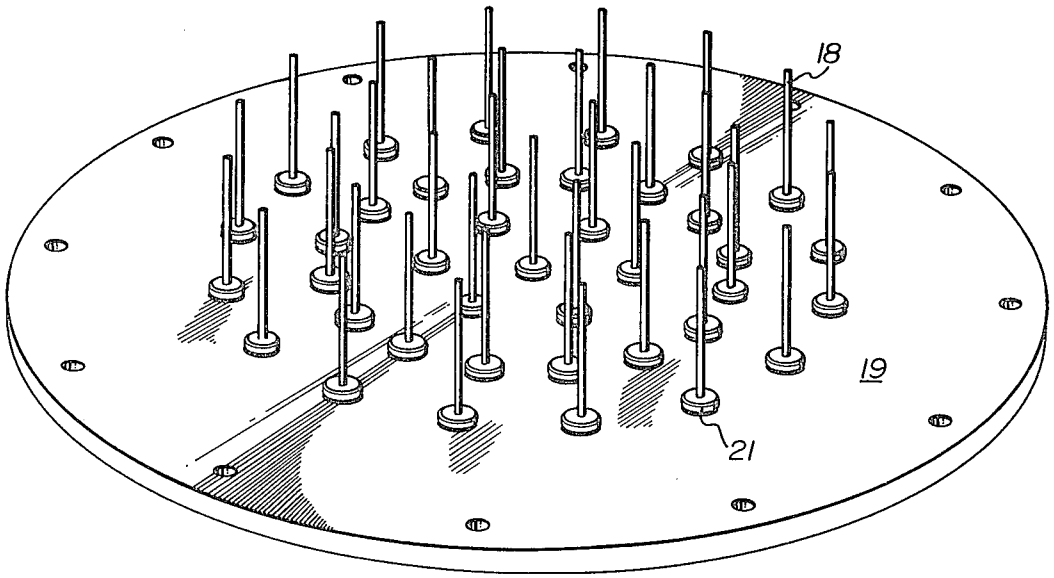
FIG. 3 is an exploded view of the bottom plate of the drop pan including a plurality of nozzles.

The molten mixture is passed to a drop pan 16 via a heated conduit 17. The bottom of the pan is formed by a removable bore plate 19 which includes a plurality of small diameter nozzles 18. In the embodiment shown, thirty-nine nozzles are arranged symmetrically around the three different diameters of the plate 19 as seen in above 3. The three different diameters are used to ensure uniform distribution of the droplets. The thirty-nine nozzles (2.06 mm inside diameters) are inserted into the bore plate 19 symmetrically around three different diameters as illustrated in FIG. 3. Each stainless steel nozzle 18, 7 cm long, is press fit into a brass cylinder 21 which is, in turn, press fit into the bore plate 19. The nozzles 18 are immersed in a water column 25 filled to an overflow 26.

Although laboratory studies into the effect of temperature on prill formation and production rate (as previously discussed) had been conducted, the operating temperature of the pilot plant power illustrated in the drawings was dictated almost solely by it performance. It was found that a temperature of 83° to 86° C, i.e. slightly above the melting point of TNT gave a satisfactory production rate with an acceptable prill size distribution. If the temperature was increased above this level, the prills were formed too rapidly, leading to problems of accumulation in the column. Also, these lower temperatures resulted in less TNt vapour being formed in the working area, a factor that was not significant in the laboratory tests.

The molten explosive suspension 10 is fed into the drop pan 16 when the recorded temperatures of the hot water in the upper Section of the column 25 and of the molten explosive 10 in the melting pot 12 and the drop pan 16, constantly oscillates between 83° and 86° C. The temperature is controlled by proportional pneumatic valves, which are actuated by monitoring units each connected to a thermocouple (not shown).

The level of explosive in the drop pan 16 is maintained by a controller (not shown) actuating the flush-mounted dumping valve 13, which is proportionally operated. This level is maintained at 6 cm for formulations containing RDX and at 1 cm for the less viscous TNT/A1 formulations.

To obtain good reproducibility of the prill size distribution and to avoid frequent blockage of the nozzles, at least the tips of the nozzles and preferably at least 4 cm of their length is immersed in hot water i.e. at a temperature at least as high the melting point of the explosive composition. Better results are also achieved if the bottom of the drop pan is about 2 mm above the level of the water in the column.

The water column 25 is heated by means 22, conveniently in the form of a stem heated copper coil, although elctric heating may be preferable in some circumstances.

Droplets 23 of the molten mixture are thus formed in the heated area of the column 25.

Cold tap water at about 10° C is continually fed into the bottom of the column 25 via an inlet 27 at a rate of about one 1/per min. to ensure that the water in the column 25 downstream of the heating means 22 is at a sufficiently low temperature to allow for quick solidification of the droplets to form prills 28 of the same general configuration as the droplets 21, i.e. before the droplets 21 reach the bottom of the column 25.

A removable catch pot 29 is provided at the bottom of the column 25 for collecting of the prills 28. When a batch has been run, the column 25 is drained by an outlet valve 30 in the bottom of the catch pot 29. A filter 31 is provided to prevent the prills 28 from draining with the water.

According to the method of the present invention, spheroidal prills may be manufactured having diameters in the range of about 1 to 5 mm and, average diameter of about 3 mm.

Drying may be achieved by means of forced air at about 40° C. Graphitization is conveniently effected by coating the prills with a very thin film of graphite. The coating may be achieved by plunging and shaking about 10 kg of dry prills at a time, in a wire mesh basket, in a colloidal suspension of graphite (8% by weight) in isopropanol for about one minute. Drying in air may be effected overnight.

A suitable coating bath may comprise colloidal graphite: technical grade, type 1540, dispersed in isopropanol, produced by Acheson Colloids Co. Port Huron Michigan.

In view of the various embodiments described above, it should be apparent to those skilled in the art that the present invention may be embodied in forms other than those specifically described herein without departing from the spirit or central characteristics of the invention. Thus, the specific embodiments described above are to be considered in all respect as illustrative and not restrictive.

The embodiments of the invention in which an exclusive property or privilege is claimed are defined as follows:

1. A free-flowing, high-density, water-resistant explosive composition, comprising 35–80% by weight trinitrotoluene, 10–30% by weight aluminum and 0–45% by weight cyclonite, in spheroidal prill form.

2. An explosive composition according to claim 1, wherein the prill diameters are in the range of about 1–5 mm.

3. An explosive composition according to claim 2, wherein the average prill diameter is about 3 mm.

4. an explosive composition according to claim 1 wherein the absolute density of the prills is in the range of about 1.83 to 2.02 g/cm$^3$ and wherein the bulk density is in the range of about 1.13 to 1.26 g/cm$^3$.

5. An explosive composition according to claim 1 wherein the spheroidal prills are coated with a thin film of graphite.

6. An explosive composition according to claim 1, comprising 80% by weight trinitrotoluene and 20% by weight aluminum.

7. An explosive composition according to claim 1, comprising 40% by weight trinitrotoluene, 40% by weight cyclonite and 20% by weight aluminum.

8. An explosive composition according to claim 7 including a thin coating of graphite.

9. A method for the manufacture of a free flowing high-density, water resistant explosive composition, said explosive composition comprising 35–80% by weight TNT, 10–30% by weight aluminum, and 0–45% by weight RDX, in spheroidal prill form, comprising:

(a) forming a molten mixture of said explosive composition, (b) forming droplets of the molten mixture, (c) solidifying the droplets by cooling to form spheroidal prills, and (d) collecting the prills.

10. A method for the manufacture of an explosive composition according to claim 9, including the additional step of graphitizing the prills.

11. A method for the manufacture of an explosive composition according to claim 10, wherein the spheroidal prills aree graphitized by plunging and shaking dry prills in a colloidal suspension of graphite in isopropanol for about one minute.

12. A method according to claim 9 wherein the molten mixture of the explosive composition is maintained at about 83°–86° C.

13. A method according to claim 9 wherein the explosive composition comprises 80% by weight aluminum.

14. A method according to claim 9 wherein the explosive composition comprises 40% by weight TNT, 40% by weight RDX and 20% by weight aluminum.

* * * * *